US007685920B2

(12) United States Patent
Paul

(10) Patent No.: US 7,685,920 B2
(45) Date of Patent: Mar. 30, 2010

(54) ARTICLE COMPRISING A CANISTER CLOSURE WITH PRESSURE-PULSE RELEASE

(75) Inventor: Buddy R. Paul, Perry Hall, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 624 days.

(21) Appl. No.: 11/141,165

(22) Filed: May 31, 2005

(65) Prior Publication Data

US 2006/0090635 A1 May 4, 2006

Related U.S. Application Data

(63) Continuation-in-part of application No. 10/283,174, filed on Oct. 30, 2002, now abandoned.

(51) Int. Cl.
*F41F 3/077* (2006.01)

(52) U.S. Cl. ..... 89/1.817

(58) Field of Classification Search ..... 70/165, 70/169; 102/223, 224; 89/174, 188, 1.817, 89/1.704

See application file for complete search history.

(56) References Cited

U.S. PATENT DOCUMENTS

| | | | | | |
|---|---|---|---|---|---|
| 2,967,640 | A | * | 1/1961 | Roberts | 220/316 |
| 3,731,837 | A | * | 5/1973 | Platts et al. | 220/315 |
| 4,134,328 | A | * | 1/1979 | Asp et al. | 89/1.817 |
| 4,572,011 | A | | 2/1986 | Mauchlen | |
| H000213 | H | * | 2/1987 | Panlaqui | 89/1.8 |
| 4,964,659 | A | * | 10/1990 | Baldwin | 292/19 |
| 5,845,800 | A | * | 12/1998 | Shaw et al. | 220/210 |
| RE36,557 | E | | 2/2000 | Brown | |

* cited by examiner

*Primary Examiner*—Stephen M Johnson
(74) *Attorney, Agent, or Firm*—DeMont & Breyer, LLC

(57) ABSTRACT

The illustrative embodiment of the present invention is a launch system that includes a closure that, in use, is attached to one or both ends of a missile canister. The closure is blown off of the canister before there is any contact between it and the nose of the missile. The closure incorporates an actuation mechanism that releases the closure when there is a rapid increase in pressure within the canister, such as when the booster of a canistered missile fires. The actuation mechanism is not, however, responsive to the magnitude of the pressure within the canister. As a consequence, the closure will not release if there is a slow build-up of pressure within the missile canister.

11 Claims, 6 Drawing Sheets

ARTICLE COMPRISING A CANISTER CLOSURE WITH PRESSURE-PULSE RELEASE

STATEMENT OF RELATED CASES

This case is a continuation-in-part of U.S. patent application Ser. No. 10/283,174, which was filed on Oct. 30, 2002 now abandoned.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Contract No. DASG60-00-C-0072 awarded by the U.S. Government.

FIELD OF THE INVENTION

The present invention relates to missile canisters, and more particularly to closures for missile canisters.

BACKGROUND OF THE INVENTION

It is well known in the art to launch a missile from a canister. The canisters are typically round or square tubes that contain a missile, missile-launch hardware such as rails and/or sabots, and electronics for initiating launch. In addition to functioning as a launch system, the canisters provide environmental protection for the missile, simplify missile-handling issues, and provide an efficient and long-term solution for missile storage.

In order to provide full environmental protection for the missile and other components within the canister, the canister must be sealed. This is typically done using a closure. The closure is ideally able to protect or isolate the missile from a variety of environmental factors yet provide substantially unimpeded passage of the missile upon launch.

A variety of canister closures are known. Some tear or shatter upon contact with the missile during launch. This is acceptable for some but not all types of missiles. In particular, some missiles (e.g., LAM, PAM, etc.) include fragile mechanisms in the nose that could be damaged on impact with the closure. Furthermore, when a missile strikes canister closure, debris is projected in a random manner, which can result in damage to nearby canisters and other items.

An alternative to a tear-through canister closure is the non-contact canister closure. A non-contact closure typically includes an actuator that releases the closure upon launch. Typically, the actuator is a pyrotechnic device that is disposed within or near the closure. The pyrotechnic device is operatively coupled to the missile so that when the missile fires, the device actuates. Upon actuation, the closure decouples from the canister, allowing the missile to egress unencumbered. Relative to tear-through-type closures, non-contact canister closures are usually heavier, more complex, and more expensive.

SUMMARY OF THE INVENTION

The present invention provides a non-contact canister closure or cap that avoids some of the costs and disadvantages of the prior art. In the illustrative embodiment, the non-contact closure is used in conjunction with a missile canister to provide an improved launch system. But it is to be understood that in other embodiments, the non-contact closure can be used in conjunction with other types of canisters to provide other types of improved systems.

The non-contact closure disclosed herein incorporates a passive actuation mechanism. In the illustrative embodiment, the mechanism is actuated by a rapid increase in pressure that occurs within a missile canister upon missile ignition. When the mechanism actuates, the closure blows off of the canister, permitting unencumbered egress of the missile.

It is notable that the release of the closure is not triggered by any particular threshold pressure within the canister. Rather, the actuation mechanism is configured to respond, effectively, to the rate at which pressure increases within the canister.

The insensitivity of the closure to canister pressure is important because the pressure within a canister can rise slowly over time (for reasons unrelated to launch). In particular, most missiles release certain gases (i.e., missile propellant). Since the missile canisters are gas-tight when sealed, off-gassing results in an increase in pressure within the canister. Although substantially elevated canister pressures can result from off gassing, the rate of increase in pressure within the canister is slow, at least compared to the rate at which pressure increases when the missile fires. In fact, the ratio of the time scales for pressure increase due to the booster firing versus missile off-gassing is about three orders of magnitude (i.e., 1000 to 1).

The sensitivity to the rate of increase of pressure and the insensitivity to pressure level that is exhibited by the actuation mechanism is referred to herein as "pressure-pulse operation." In accordance with the illustrative embodiment, pressure-pulse operation is provided by configuring the actuation mechanism so that it:

- is capable of equalizing pressure between the interior of the canister and a cavity within the closure when the pressure within the canister rises relatively slowly, but not when the canister pressure rises rapidly; and
- actuates at threshold pressure differential, as established between the interior of the canister and the cavity.

A variety of closure/actuator configurations can be developed to satisfy the requirements specified in the preceding paragraph. In the illustrative embodiment, this is achieved by a closure that incorporates an (outer) cover and a pressure plate that are coupled to and spaced apart from one another. A spring-biasing element is disposed between the cover and the plate. The biasing element biases the plate away from the cover.

A rim is disposed along the edge of the cover. When the closure is coupled to a missile canister, the rim extends inwardly into the canister and is substantially perpendicular to the walls of the canister. The cover is dimensioned so that outer diameter of the rim is slightly smaller than the inside diameter of the muzzle of the canister.

The rim includes a plurality of holes through which a plurality of coupling elements, such as steel balls, protrude. The steel balls are received by a recess in the inner wall of the canister. The pressure plate also includes a rim, a portion of which abuts the coupling elements so that they are biased against inner wall of the canister. In this fashion, the coupling elements couple the closure to the canister.

When the pressure plate is subjected to a force (e.g., the pulse of pressure that results when a canistered missile fires, etc.) that is sufficient to compress the biasing element, the pressure plate moves toward the outer cover. The rim of the pressure plate is configured so that as it moves toward the cover, it loses contact with the coupling elements or otherwise permits them to withdraw from recess in the wall of canister and "retract" into or through the rim of the cover. This decouples the closure from the canister. Urged by the pressure within the canister, the closure blows off, which enables the missile to egress the canister unimpeded.

Leakage paths are provided through the pressure plate so that to the extent that there is a slow accumulation in pressure within the canister, there is time for the pressure to equalize across the closure. That is, the pressure in the cavity that is formed between the outer cover and the pressure plate is equal to the pressure within the canister body. When pressure is equalized, there is no net force acting on the pressure plate that would cause it to compress the biasing element, move toward the cover, and release the coupling elements.

The closure disclosed herein can be used on either the egress (muzzle) end of a missile canister, the breech end, or both. Of course, different conditions prevail at the breech end than the muzzle end when a canistered missile fires. In particular, the breech-end closure receives the missile plume directly, while the muzzle end closure does not. In some embodiments, the breech-end closure incorporates one or more physical adaptations that address this difference, as described later in this Specification.

One embodiment of the invention is an article comprising a closure for a canister, wherein the closure comprises:

1. an outer cover, wherein the outer cover is dimensioned to substantially seal an end of the canister; and
2. a passively-actuated actuation mechanism for reversibly coupling said closure to said canister, wherein said actuation mechanism:
   (i) is operably coupled to said outer cover; and
   (ii) is physically configured to provide pressure-pulse operation.

Additional disclosure concerning the foregoing features, as well as description of other features of a non-contact closure in accordance with the illustrative embodiment, are provided later in the Detailed Description and the appended Drawings.

DETAILED DESCRIPTION

Definitions

The following terms are defined for use in this Specification, including the appended claims:

Mechanically-coupled means that movement of one device affects another device via direct conduction of mechanical force. This could be through direct contact, as in the case of two devices in physical contact; a physical linkage (a third element) that connects two devices, or wherein a force-conducting medium (e.g., pneumatic fluid, hydraulic fluid, etc.) is used. As used herein, a vacuum is not a force-conducting medium.

Operatively-coupled means that the operation of one device affects another device, with no restrictions on the nature of the coupling (e.g., physical, optical, thermal, electromagnetic, etc.).

Physically-coupled means that items are in direct, physical contact.

Pressure-pulse operation means a mode of operation that is characterized by a sensitivity or responsiveness to a (threshold) rate of pressure change, but an insensitivity or non-responsiveness to pressure level.

Overview and Theory of Operation

Figure 1:
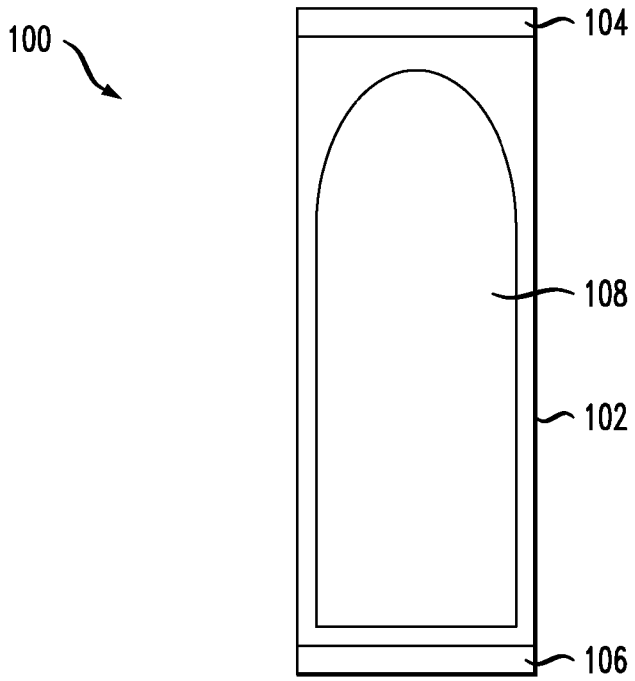
FIG. 1 depicts a launch system having canister closures that are configured for pressure-pulse operation in accordance with the illustrative embodiment of the present invention.

FIG. 1 depicts missile launch system 100 in accordance with the illustrative embodiment of the invention. The system includes missile canister 102, muzzle-end closure 104, breech-end closure 106, and missile 108. Canister 102 usually contains any one or more of a variety of internal elements or mechanisms, such as rails and/or sabots, and electronics for initiating launch, as is well known to those skilled in the art. Since these internals are not germane to an understanding of the present invention, they will not be described in this specification.

In accordance with the illustrative embodiment, muzzle-end closure 104 and breech-end closure 106 are blown away from canister 102 during launch. Breech-end closure 106 is an optional feature of missile launch system 100. More precisely, the breech end of canister 102 must be sealed in some fashion, but the use of closure 106, having the features described herein, is optional.

Closures 104 and 106 have a shape or form that is consistent with the shape of canister 102. That is, in embodiments in which canister 102 has a cylindrical cross section, closures 104 and 106 are round. In embodiments in which canister 102 has a polygonal cross section (e.g., square, etc.), the closures have a complementary polygonal shape.

Closures 104 and 106, or, more properly, the actuation mechanism that is a part of these closures, are configured to exhibit pressure-pulse operation. As defined above, pressure-pulse operation is characterized by sensitivity or responsiveness to the rate of increase of pressure in canister 102 and an insensitivity or lack of responsiveness to pressure level in the canister. Simply put, closures 104 and 106 will be blown off of canister 102 in response to a spike or pulse of pressure within the canister, but not in response to any particular threshold pressure, regardless of its magnitude.

Figure 2:
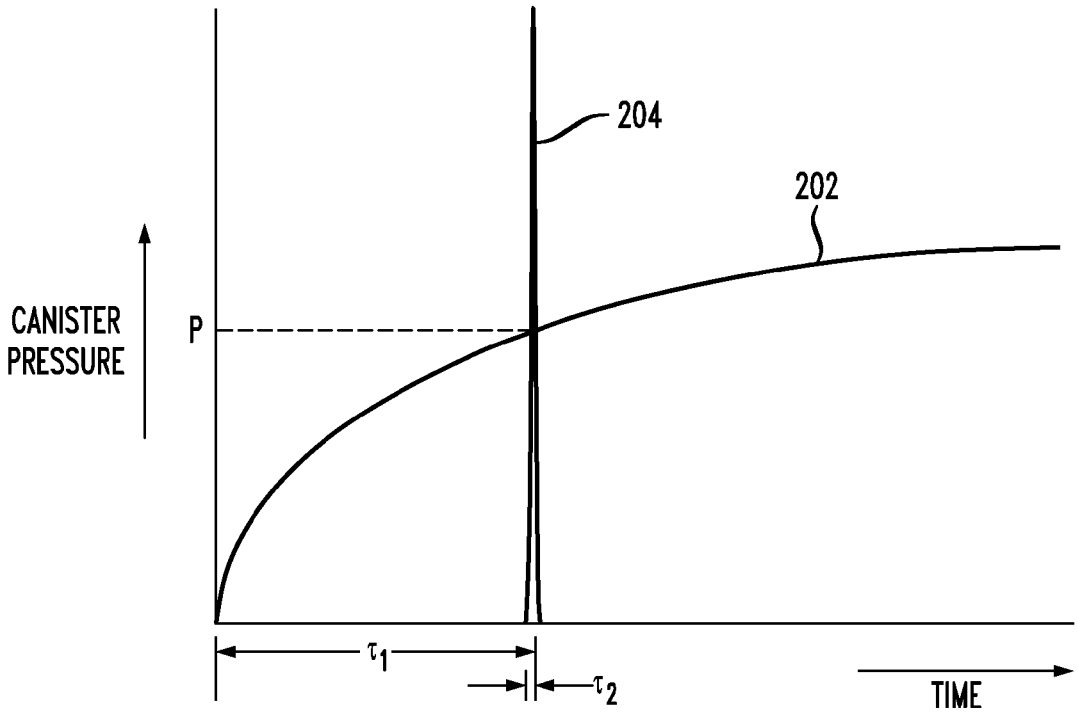
FIG. 2 depicts a plot that compares a pressure pulse to a slow accumulation of pressure within a missile canister.

FIG. 2 depicts plots 202 and 204, which are plots of canister pressure as a function of time. Plot 202 depicts a slow increase in canister 102, as typically results from missile off gassing. When the pressure within canister 102 rises in this slow, gradual fashion, closures 202 and 204 will not be blown off of the canister, regardless of the level to which the pressure rises.

Plot 204 depicts a pressure pulse or spike, as typically occurs when the booster of a canistered missile fires. When the pressure within canister 102 rises very rapidly, as depicted by plot 204, closures 104 and 106 will be blown off of the canister.

With continuing reference to FIG. 2, the elapsed time $\tau_1$ that it takes for the canister pressure to rise to arbitrary value P due to missile off-gassing is several orders of magnitude slower than the elapsed time $\tau_2$ for the pressure to rise to the same value as a result of booster ignition. In fact, the ratio of $\tau_2$ to $\tau_1$ is about 1000 to 1.

A closure in accordance with the illustrative embodiment takes advantage of this difference in time scale. In particular, and in accordance with the illustrative embodiment, pressure-pulse operation is implemented in closures 104 and 106 by providing an actuation mechanism that:

1. is capable of equalizing pressure between the interior of the canister and a cavity within the closure when the pressure within the canister rises relatively slowly, but is not capable of equalizing pressure when the canister pressure rises rapidly; and
2. actuates at threshold pressure differential, as established between the interior of the canister and the cavity.

Structural Implementation

Figure 3:
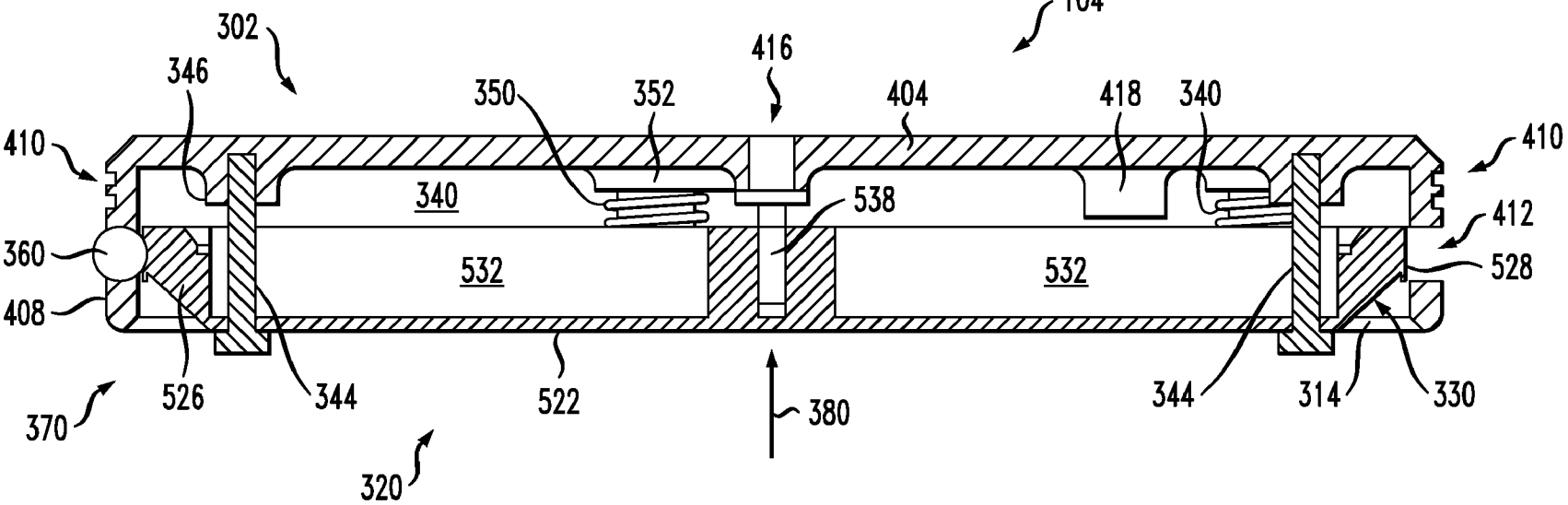
FIG. 3 depicts an illustrative embodiment of a canister closure for use in the launch system of FIG. 1.
Figure 5:
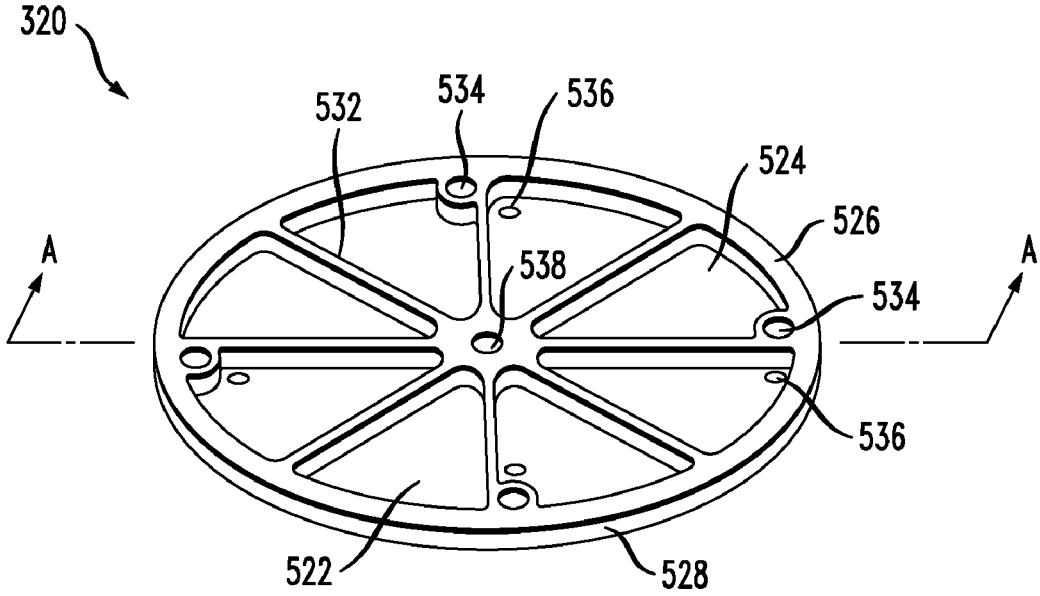
FIG. 5 depicts a perspective view of the internals of the pressure plate of the closure of FIG. 3.

FIG. 3, which is a cross-sectional view along the line A-A of FIG. 5, in the direction indicated, depicts a canister closure in accordance with the illustrative embodiment of the invention. As depicted in FIG. 3, the closure is a muzzle-end closure; that is, closure 104. It is to be understood, however, that the muzzle-end closure and the breech-end closure function in the same manner, both exhibiting pressure-pulse operation. As a consequence, the description of muzzle-end closure 104 applies to breech-end closure 106, as least as far as implementation of pressure-pulse operation is concerned. Breech-end closure 106 incorporates several additional features that are not found on muzzle-end closure 104. Those additional features are described later in this Specification in conjunction with FIGS. 7 and 8.

Figure 4:
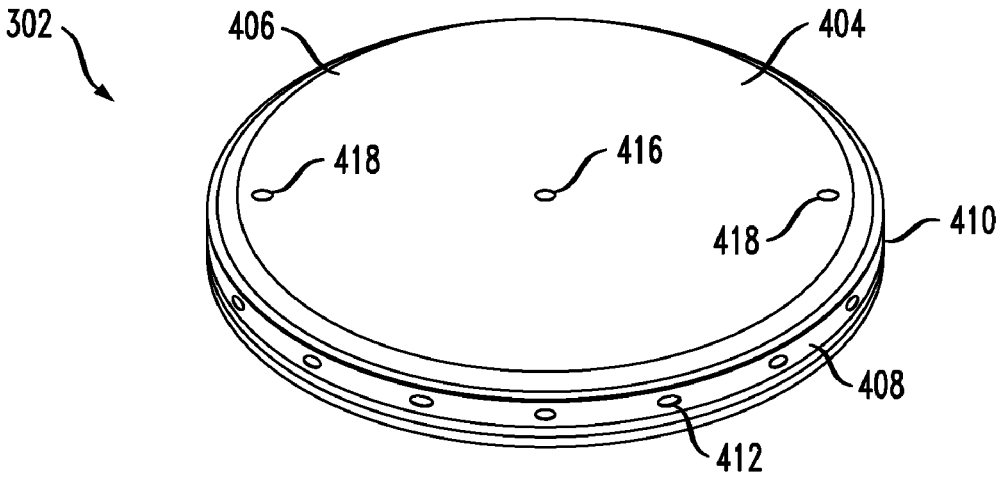
FIG. 4 depicts a perspective view of the outer cover of the closure of FIG. 3.

As depicted in FIG. 3, closure 104 includes outer cover 302 and actuation mechanism 370. The actuation mechanism comprises pressure plate 320, spring-biasing element(s) 350, and coupling element(s) 360, interrelated as shown. FIG. 4 depicts a perspective view (external) of outer cover 302 and FIG. 5 depicts a perspective view (internal) of pressure plate 320.

Referring now to FIGS. 3 and 4, outer cover 302 includes major surface 404. The major surface is a substantially continuous portion of material that is suitably dimensioned (e.g., size and shape) to block an end of the canister. Rim 408 depends from marginal region 406 of major surface 404. The rim extends orthogonally from major surface 404.

Continuous grooves 410 are disposed on rim 408 of outer cover 302 near major surface 404. The grooves each receive an o-ring or like device to provide a gas-tight seal between closure 104 and canister 102.

Further along rim 404 is a plurality of regularly-spaced openings 412 that extend completely through the rim. Each opening 412 is sized to receive coupling element 360. In the illustrative embodiment, the coupling element is a steel ball (e.g., ball bearing, etc.). For clarity, coupling element 360 is omitted from one of the two openings 412 that are depicted in FIG. 3. Coupling elements 360 are described in further detail later in this Specification.

Referring now to FIGS. 3 and 5, pressure plate 320 comprises major surface 522. The major surface is a substantially continuous portion of material that is dimensioned to be slightly smaller than outer cover 302. When appropriately coupled to outer cover 302, major surface 522, in conjunction with lip 314 that depends from rim 408, is effectively the same dimension as major surface 404.

Rim 526 depends from marginal region 524 of major surface 522. The rim extends orthogonally from major surface 522. When outer cover 302 and pressure plate 320 are coupled, rim 526 of the pressure plate is disposed within the rim of outer cover 302 and extends upwardly toward major surface 404 of outer cover 302. It is to be understood that terms such as "upwardly," "downwardly," "above," "below," etc., are relative terms used to describe what is being presented in a particular Figure. In particular, the orientation of outer cover 302 and pressure plate 320 are reversed in breech-end closure 106 from their orientation in muzzle-end closure 104. In this context, the terms "upward" and "above" can be understood to mean "outward;" that is, away from the interior of canister 102. It is clear that outer cover 302 is always "outward" of pressure plate 320. Similarly, the terms "downward" and "below" should be understood to mean "inward"—toward the interior of the canister.

Pressure plate 320 incorporates a plurality of radially-extending ribs 532. The ribs strengthen pressure plate 320. The pressure plate also includes a plurality of holes 536 that are disposed in major surface 522. Shoulder screws 344 pass through holes 536 and are received by threaded regions 346, which are disposed on the "underside" of major surface 404 of outer cover 302. When threaded into regions 346, shoulder screws 344 couple the pressure plate to the outer cover.

When outer cover 302 is coupled to pressure plate 320, the "underside" of the outer cover does not abut the uppermost surfaces of the pressure plate. In other words, when pressure plate 320 is resting against the head of each shoulder screw 344, there is room for "upward" movement of the pressure plate toward outer cover 302. Cavity 340 is formed in the region between the major surface 404 of outer cover 302 and major surface 522 of pressure plate 320.

Spring-biasing elements 350 are disposed within cavity 340. In the illustrative embodiment, four spring-biasing elements are disposed in the cavity (only two of which can be seen in the cross-sectional view of FIG. 3). But in some other embodiments, more biasing elements 350 are suitably used, and in yet some further embodiments, less biasing elements 350 are used. In the illustrative embodiment, spring-biasing elements 350 are not coaxial with outer cover 302 and pressure plate 320.

In the illustrative embodiment depicted in FIG. 3, each spring-biasing element 350 is a spring. One end of each spring is referenced against major surface 522 of pressure plate 320 and the other end of each spring is referenced against major surface 404 of outer cover 302. Receivers 534 in pressure plate 320 and receivers 352 in outer cover 302 are used to keep biasing elements 350 in a desired position and location within cavity 340.

Spring-biasing elements 350 bias or force pressure plate 320 away from outer cover 302. Those skilled in the art will recognize that a variety of other arrangements can be used to "bias" pressure plate 320 away from outer cover 302. That is, the phrase "spring-bias" is not intended to limit actuation mechanism 370 to the use of springs; rather, it is meant to indicate the functionality of element 350. For example, and without limitation, in some embodiments, spring-biasing element 310 is a resilient material, and in some further embodiments, the spring-biasing element is a magnet.

From the foregoing description, it will be understood that biasing elements 350 act to force pressure plate 320 away from outer cover 302 to the extent permitted by the shoulder screws 344. Consequently, a force of sufficient magnitude that is exerted against major surface 522 of the pressure plate in the direction indicated by arrow 380, will be capable of moving the pressure plate "upwards" toward outer cover 302. This capability, which is the basis for the operation of the illustrative embodiment, will be described in more detail later in this Specification.

With continuing reference to FIG. 3, the profile of rim 526 of pressure plate 320 varies, thereby providing a change in the effective diameter of the pressure plate. Using major surface 522 as a starting point, rim 526 tapers "upward" in region 330 until it reaches its maximum diameter at edge 528. At that point, the profile of rim 526 is vertical. In other words, given the visual perspective of FIG. 3, the profile of rim 526 comprises vertically-oriented surface or edge 528 and undercut surface 330, wherein the undercut surface declines at an acute angle with respect to edge 528.

As depicted in FIG. 3, edge 528 of rim 526 abuts coupling element 360. Edge 528 maintains coupling element 360 in its position within hole 412. The coupling elements are dimensioned so that, when in the position depicted in FIG. 3, a portion of the coupling element protrudes past the edge of rim 408. As described later in conjunction with FIG. 6A, the protruding portion of coupling elements 360 engage a recess that is disposed in the inner wall of canister 102.

This arrangement, wherein coupling elements 360 are maintained in position by edge 528, and wherein, in that position, they protrude beyond rim 408 to engage a recess in the canister, is the way in which closure 104 is coupled to canister 102.

Operation of the Illustrative Embodiment

Figure 6A:
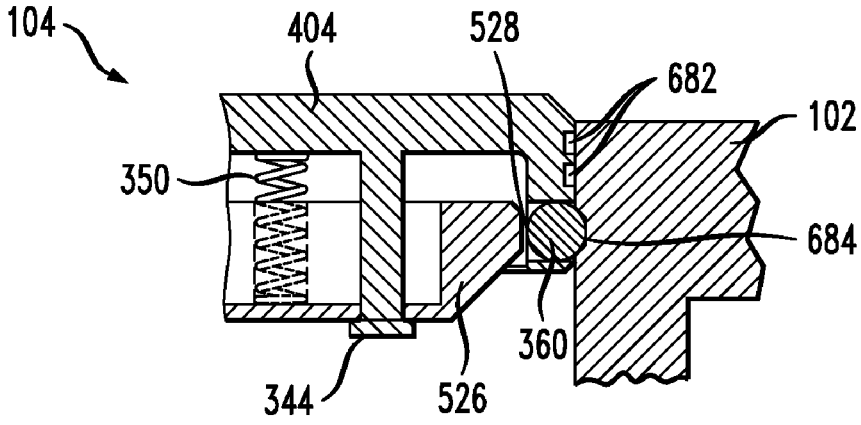
FIG. 6A depicts a portion the closure of FIG. 3, wherein the closure is coupled to the canister.
Figure 6B:
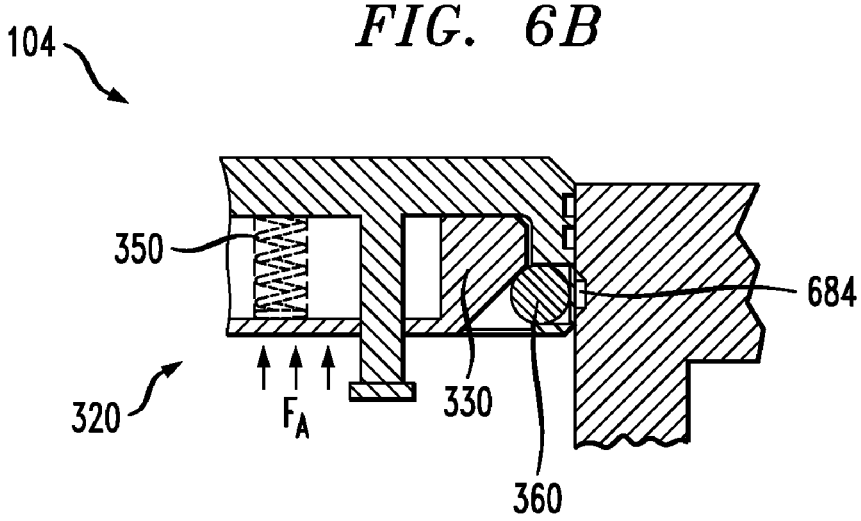
FIG. 6B depicts the portion of the closure that is shown in FIG. 6A, but during release of the closure from the canister.

FIGS. 6A and 6B depict a portion of closure 104, as coupled to canister 102. FIG. 6A depicts the closure 104 in a coupled state, as in FIG. 3. FIG. 6B depicts closure 104 as it decouples from canister 102, but before it blows off of the canister.

With reference to FIG. 6A, biasing element 350 is extended (i.e., not fully compressed) to the extent permitted by shoulder screw 344. Seals 682 are depicted in grooves 410 of canister 102. As previously indicated, seals 682 provide a gas-tight seal thereby environmentally isolating the interior of canister 102 from the external environment. Coupling element 360 is restrained in its coupling position by edge 528 of rim 526. A portion of coupling element 360 is received by recess 684 in canister 102.

FIG. 6B depicts closure 104 in a decoupled state. The closure and the canister decouple as pressure plate 320 moves toward outer cover 302. With upward movement toward the outercover, angled region 330 of rim 526 is presented to coupling element 360. This effectively decreases the diameter of the pressure plate, such that coupling element 360 retracts slightly within opening 412 in rim 408 of outer cover 302. As the coupling element retracts, it disengages from recess 684, thereby releasing closure 104 from canister 102. Openings 412 can be tapered so that when pressure plate 320 moves upward, the balls 360 roll away from canister 102 toward the interior of closure 104. Thus, pressure plate 320 and coupling elements 360 moves in substantially orthogonal directions during release of closure 104.

As previously disclosed, when a force $F_A$ of sufficient magnitude is exerted against major surface 522 of the pressure plate, the pressure plate will move toward outer cover 302. As just described, this upward movement releases closure 104 from canister 102.

More particularly, pressure plate 320 moves toward outer cover 302 when subjected to a force, $F_A$, such as pressure, that overcomes the biasing force, $F_B$, provided by spring-biasing elements 350 as well as weight $W_{pp}$ of pressure plate 320.

By way of example, when pressure $P_1$ in canister 102 is greater than pressure $P_2$ in cavity 340 by some minimum threshold δ (that overcomes biasing force $F_B$ and the weight $W_{pp}$ of the pressure plate), pressure plate 320 moves toward outer cover 302, releasing coupling elements 360 from recess 684 in canister 102.

$$\text{Thus, if: } P_1 > P_2 + \delta, \text{ then closure } \mathbf{104} \text{ releases.} \quad [1]$$

When pressure $P_1$ in canister 102 is equal to the pressure $P_2$ in cavity 340, or does not exceed pressure $P_2$ by the minimum threshold δ, pressure plate 320 will not move toward outer cover 302, or does not move far enough to release coupling elements 360 from recess 684.

$$\text{Thus, if: } P_1 - P_2 \leqq \delta, \text{ then the closure does not release.} \quad [2]$$

Some configurations of actuation mechanism 370 have the potential to be actuated by forces other than the pressure that is generated when the missile fires. An example of such a force is "rail shock;" that is, the vibration or shock that is transmitted to actuation mechanism 370 during transportation (e.g., by rail, etc.). It is very important that actuation mechanism 370 does not actuate when subjected to such a force. In the illustrative embodiment, biasing force $F_B$ and the weight of pressure plate 320 must be sufficient to prevent rail shock or other non-launch-related forces from actuating the actuation mechanism. Yet, during launch, the weight of pressure plate 320 and biasing force $F_B$ must be overcome to actuate the actuation mechanism so that closure 104 releases from canister 102. An approach for determining the required biasing force $F_B$ of spring-biasing element 350 is provided below.

Pressure plate 320 is advantageously light as possible to enable a quick actuation response. A quick response lessens the chance that pressure will equalize across pressure plate 308, thereby preventing the release of closure 104. Of course, the material used must also satisfy other requirements, such as resistance to corrosion and an ability to contain high pressure. In some embodiments, light-weight, high-strength aluminum is used as the material of construction for pressure plate 320. In some other embodiments, various composite materials are used. Those skilled in the art, in view of the present disclosure, will be able to suitably select materials of construction for pressure plate 320 as well as other elements of closure 104.

For the design of spring-biasing element 350, the rail shock requirement is assumed to be 20 g's. A safety factor of 50% (1.5) is used to guard against accidental release of the closure. The minimum biasing force $F_{Bmin}$ necessary to counteract the rail shock is given by:

$$F_{Bmin} = \text{Rail shock} \times \text{Weight of Pressure Plate} \times 1.5 \quad [3]$$

A pressure plate that is about 12 inches in diameter and that is formed from light-weight, high-strength aluminum will weigh about 1 pound. As such, the minimum biasing force requirement is:

$$F_{Bmin} = 20\text{ g} \times 1\text{ pound} \times 1.5 = 30\text{ lbs of force.} \quad [4]$$

The minimum pressure pulse $P_{min}$ that will begin to dislodge pressure plate 308 is given by:

$$P_{min} = F_{Bmin}/\text{Area of Pressure Plate} \quad [5]$$

Given a 12 inch pressure plate, the pressure pulse that will begin to dislodge the pressure plate is:

$$P_{min} = 30\text{ pounds}/[\pi \times 6\text{ in}^2] \approx 0.3\text{ pounds per square inch} \quad [6]$$

Thus, a minimum pressure differential of about 0.3 psi across pressure plate 320 is required to overcome the biasing force and weight of the pressure plate. This minimum pressure will start pressure plate 320 moving. In some embodiments, pressure plate 320 must travel about 0.1 inch to release coupling elements 360. As a function of the spring constant, it can take an additional 10 to 15 pounds of force to move pressure plate 360 the required distance:

$$0.3\text{ psi}+(15/[\pi\times 6\text{ in}^2])\approx 0.5\text{ pounds per square inch} \quad [7]$$

In other words, for this example, a threshold pressure differential δ (across pressure plate 320) of about 0.5 psi must be exceeded to actuate actuation mechanism 370 and dislodge pressure plate 320. Those skilled in the art, after reading the present disclosure, will be able to design and implement spring-biasing element 360 so that closure 104 releases upon missile firing, but not when exposed to shock.

It was previously disclosed that in the illustrative embodiment, pressure-pulse operation is implemented by providing an actuation mechanism that (1) actuates at a threshold pressure differential, and (2) is capable of equalizing pressure between the interior of the canister and a cavity within the closure when the pressure within the canister rises relatively slowly.

The first characteristic has been described above. As to the second, actuation mechanism 370 provides certain "leak paths" that enable pressure to equalize across pressure plate 320. If the pressure equalizes, there is no pressure-based force to overcome biasing force $F_B$ and the weight $W_{pp}$ of pressure plate 320, such that the closure will not release.

With continuing reference to FIGS. 5 and 6A, leak paths exist between holes 536 in major surface 522 of pressure plate 320 and at interface of surface 528 of rim 526 and coupling elements 360 for closure 104. An additional leak path exists for certain embodiment of breech-end closure 106, as described in conjunction with FIG. 8.

The design for leakage is dependent, to some extent, on the rate at which gas fills canister 102 during a pressure pulse, such as missile ignition. The greater the rate at which gas fills canister 102, the greater amount of leakage can be tolerated. It has been found that a gap of about 0.03 inches between abutting surfaces, which is slightly more than a "slip fit" gap, is suitable when the pressure pulse is sourced from missile ignition.

Assembly

Referring now to FIGS. 4 and 5, outer cover 302 includes three holes: hole 416, which is centrally located, and holes 418, which are at substantially diametrically-opposed locations. Hole 416, which extends through outer cover 302, is used for engaging closure 104 to canister 102. In particular, a threaded hand crank is inserted through hole 416 and received by threaded hole 538 in pressure plate 320. The hand crank creates a screw effect thereby collapsing spring-biasing elements 350. When the spring-biasing elements collapse, coupling elements 360 withdraw into holes 412. This enables closure 104 to be inserted into the muzzle end of canister 102. When the hand crank is removed, biasing elements 360 return to a less compressed state. As a consequence, coupling elements 360 are forced outward to protrude through holes 412, thereby locking closure 104 in place. A small tube extends from the mouth of opening 416 to hole 538, such that there is no leakage (of air) from the ambient environment into cavity 340.

The other two holes, holes 418, are not through holes. They are used to engage tooling. The tooling insures that, at assembly, closure 104 is inserted evenly into canister 102 and is clocked to the proper rotation. Holes 418 are optional in the sense that closure 104 can be inserted without the tool. Use of the tool, however, reduces the possibility that o-rings 682 will be damaged when closure 104 is inserted into canister 102.

Breech-End Closure

As previously disclosed, breech-end closure is directly exposed to the missile plume when a canistered missile fires. As a consequence, some embodiments of breech-end closure 106 include certain features or physical adaptations that are not found on muzzle-end closure 104.

Figure 7:
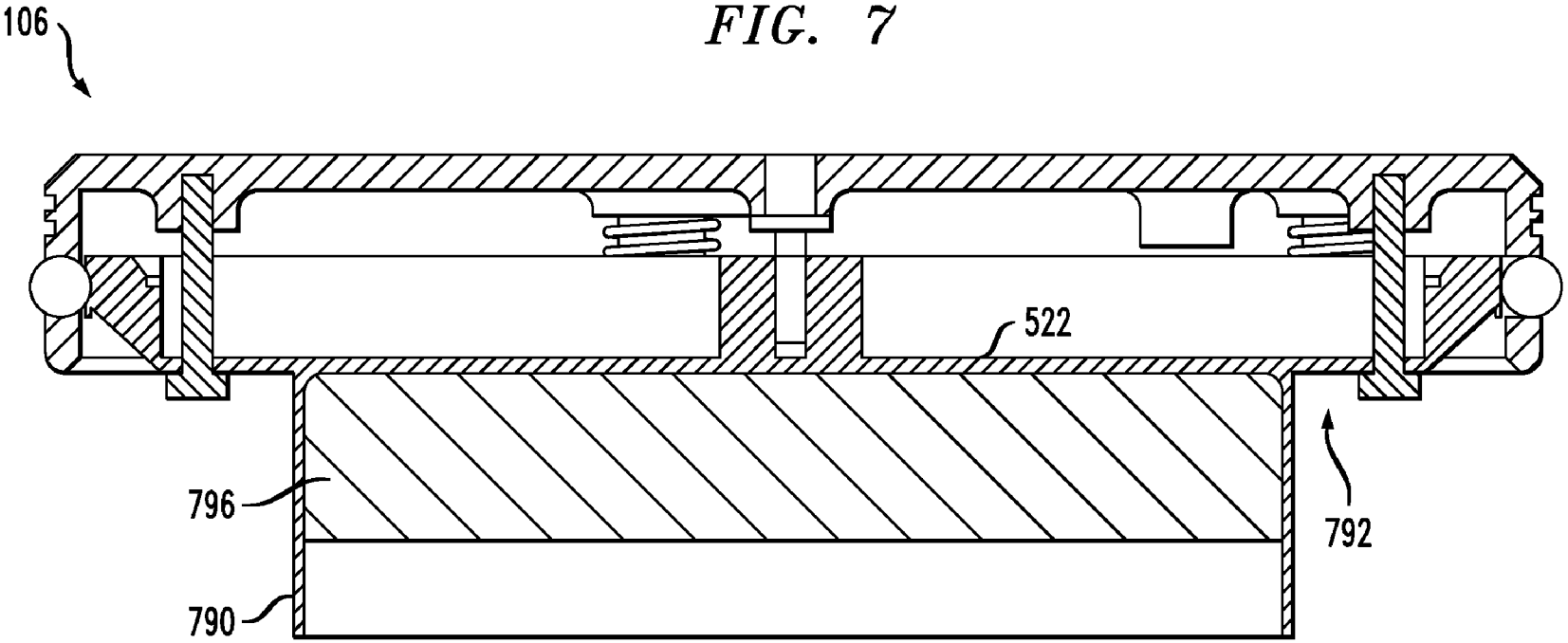
FIG. 7 depicts a cross section of a variation of the closure of FIG. 3, wherein the closure is specifically adapted for use as a breech-end closure.
Figure 8:
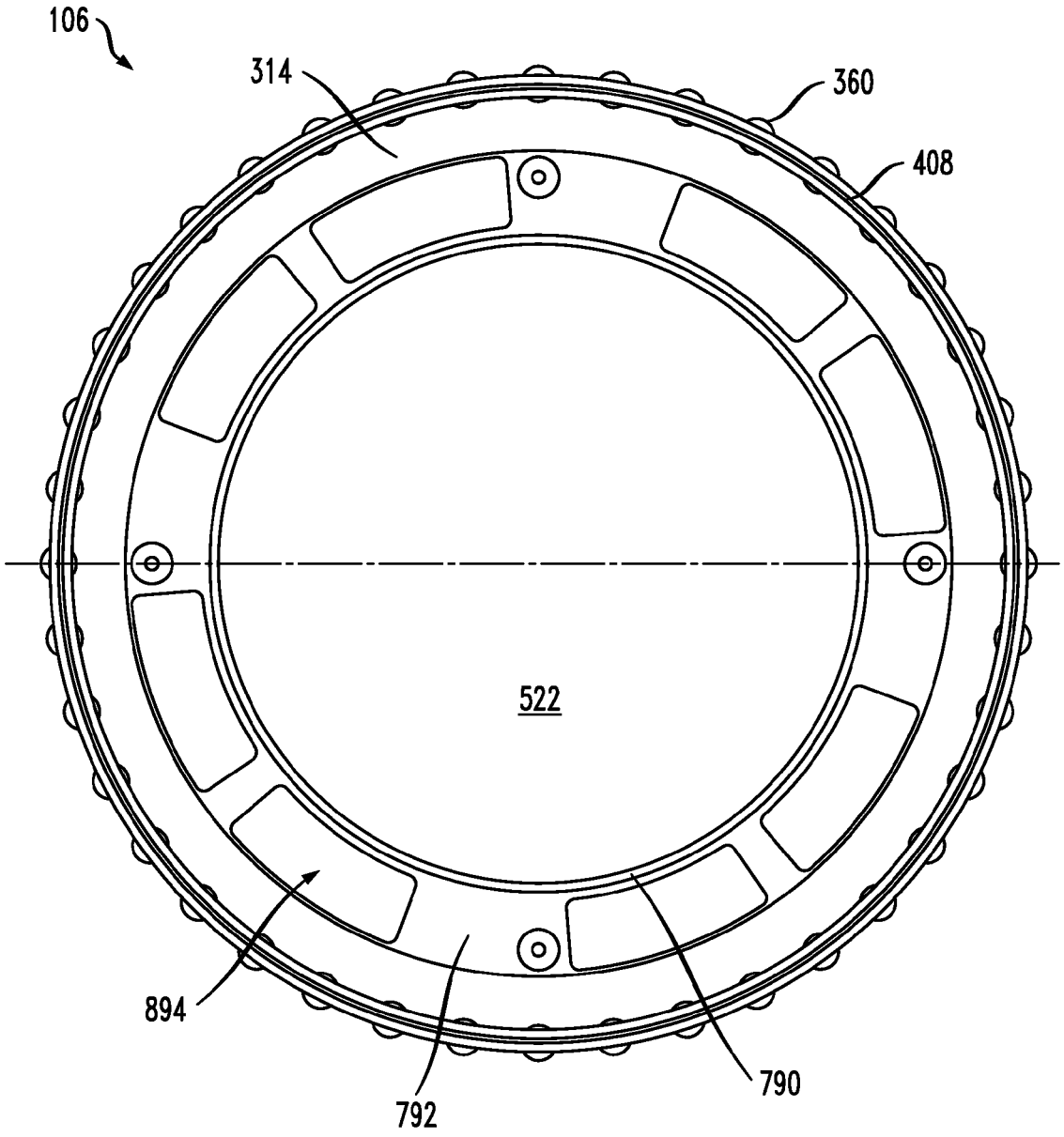
FIG. 8 depicts a bottom view of the closure of FIG. 7.

Referring now to FIGS. 7 and 8, breech-end closure 106 incorporates plume ring 790, foam 796, and slots 894. A purpose of plume ring 790 is to contain the plume that is generated when the missile's booster fires. The allowable backpressure in canister 102 is typically limited by the missile's seals. Plume ring 790 prevents the backpressure from reaching the seals. Acoustic foam 796 that is capable of withstanding the hot, corrosive plume is disposed within the plume ring.

Plume ring 790 is coaxial with respect to pressure plate 320 and outer cover 302. As depicted in the Figures, plume ring 790 has a smaller diameter than the pressure plate. The diameter is selected to capture substantially all of the missile plume.

As seen in FIG. 8, which is a bottom view of closure 106, a plurality of openings 894 are located in peripheral region 792 of major surface 522 of the pressure plate. These relatively large openings provide weight reduction for closure 106 as well as providing an additional leak path for pressure equalization. Not withstanding the presence of openings 894, pressure equalization will not occur across closure 106 during launch. This is because plume ring 790 captures substantially all of the missile plume and there are no openings through pressure plate 320 within the confines of the plume ring.

Other than the few features mentioned above, the structure of breech-end closure 106 is identical to the structure of muzzle-end closure 104. Note that in FIG. 8, coupling elements 360 (i.e., balls in the illustrative embodiment) are shown protruding at a plurality of equally-spaced locations from rim 408.

It is to be understood that the above-described embodiments are merely illustrative of the present invention and that many variations of the above-described embodiments can be devised by those skilled in the art without departing from the scope of the invention.

For example, in the illustrative embodiment, rim 526 of pressure plate 320 has a tapered or angled profile that enables coupling elements 360 to move away from canister 102 when the pressure plate moves toward outer cover 302. But different profiles will accomplish the same result. For example, in some embodiments, rim 526 has a "stepped" profile. Those skilled in the art will be able to develop a variety of different profiles for rim 526, in light of the present disclosure, that are suitable for coupling/decoupling the coupling elements with canister 102.

It is therefore intended that such variations, and others that will occur to those skilled in the art in view of the present disclosure, be included within the scope of the following claims and their equivalents.

I claim:

1. An article comprising a closure for a canister, wherein the closure comprises:

an outer cover, wherein the outer cover is dimensioned to substantially seal an end of said canister; and a passively-actuated actuation mechanism for reversibly coupling the closure to the canister, wherein the actuation mechanism comprises:

a pressure plate, wherein the pressure plate is spaced apart from the outer cover, defining a cavity therebetween;

a spring-biasing element for biasing the pressure plate away from the outer cover, wherein the spring-biasing element is disposed in the cavity; and a coupling element for reversibly coupling the outer cover to the canister, wherein the pressure plate is operatively coupled to the coupling element; and a ring, wherein the ring depends from a major surface of the pressure plate that faces away from the outer cover, wherein the ring is coaxial with the pressure plate, wherein a diameter of the ring is smaller than a diameter of the pressure plate, wherein the major surface of the pressure plate comprises a plurality of openings, and wherein the openings are disposed at a peripheral region of the plate that begins radially outward of the ring.

2. The article of claim 1 wherein the outer cover comprises a rim that depends from a marginal region thereof and wherein the rim comprises a physical adaptation for receiving the coupling element and facilitating engagement with a surface of the canister.

3. The article of claim 2 wherein a profile of the rim of the pressure plate varies, thereby providing a change in the effective diameter of the pressure plate.

4. The article of claim 3 wherein the profile comprises a vertical surface and an undercut surface, wherein the undercut surface declines at an acute angle with respect to the vertical surface.

5. The article of claim 1 wherein the coupling element comprises a plurality of balls.

6. The article of claim 5 wherein the physical adaptation comprises a plurality of openings for receiving the balls.

7. The article of claim 1 further comprising the canister.

8. The article of claim 1 further comprising a missile, wherein the missile is disposed in the canister.

9. The article of claim 8 wherein the closure seals a breech end of the canister.

10. The article of claim 1 wherein the spring-biasing element and the closure are not coaxially aligned with one another.

11. An article comprising a closure for a canister, wherein the closure comprises:

an outer cover, wherein the outer cover is dimensioned to substantially seal an end of said canister; and a passively-actuated actuation mechanism for reversibly coupling the closure to the canister, wherein the actuation mechanism comprises:

a pressure plate, wherein the pressure plate is spaced apart from the outer cover, defining a cavity therebetween;

a spring-biasing element for biasing the pressure plate away from the outer cover, wherein the spring-biasing element is disposed in the cavity;

a coupling element for reversibly coupling the outer cover to the canister, wherein the pressure plate is operatively coupled to the coupling element; and leak paths through the pressure plate that enable pressure to equalize between the cavity and an interior of the canister being sealed by the closure as a function of a rate at which the pressure within the canister rises, the passively-actuated actuation mechanism thereby providing pressure-pulse operation wherein the actuation mechanism is responsive to a threshold rate of pressure change but non-responsive to absolute pressure level.

* * * * *